US007925040B2

(12) United States Patent
Kitazawa et al.

(10) Patent No.: US 7,925,040 B2
(45) Date of Patent: Apr. 12, 2011

(54) SPEAKER

(75) Inventors: Hideo Kitazawa, Nagano (JP); Akinori Ushikoshi, Nagano (JP); Takamasa Kaneko, Shizuoka (JP); Kenji Yokoyama, Tokyo (JP)

(73) Assignee: Nidec Pigeon Corporation (JP)

( * ) Notice: Subject to any disclaimer, the term of this patent is extended or adjusted under 35 U.S.C. 154(b) by 1345 days.

(21) Appl. No.: 11/447,321

(22) Filed: Jun. 6, 2006

(65) Prior Publication Data

US 2006/0285704 A1 Dec. 21, 2006

(30) Foreign Application Priority Data

Jun. 7, 2005 (JP) ..... 2005-167529

(51) Int. Cl.
*H04R 1/00* (2006.01)

(52) U.S. Cl. ..... 381/407; 381/400; 381/417

(58) Field of Classification Search ..... 381/317, 381/400, 407, 410
See application file for complete search history.

(56) References Cited

U.S. PATENT DOCUMENTS 4,924,858 A * 5/1990 Katona ..... 601/4
2003/0218391 A1* 11/2003 Hirata ..... 310/12

FOREIGN PATENT DOCUMENTS

| | | |
|---|---|---|
| JP | 52-079644 | 7/1977 |
| JP | 53-012319 | 2/1978 |
| JP | 53-012320 | 2/1978 |
| JP | 53-012321 | 2/1978 |
| JP | 53012320 A * | 2/1978 |

* cited by examiner

*Primary Examiner* — Curtis Kuntz
*Assistant Examiner* — Sunita Joshi
(74) *Attorney, Agent, or Firm* — Cantor Colburn LLP

(57) ABSTRACT

A speaker may include a center pole and a voice coil bobbin having a bobbin that may include nonmagnetic and electric conductor layers and insulator layers disposed between the electric conductor layers. An electrostatic capacity, which is formed between the center pole and the voice coil bobbin, is detected and outputted as an electrical signal.

4 Claims, 6 Drawing Sheets

【Fig.1】
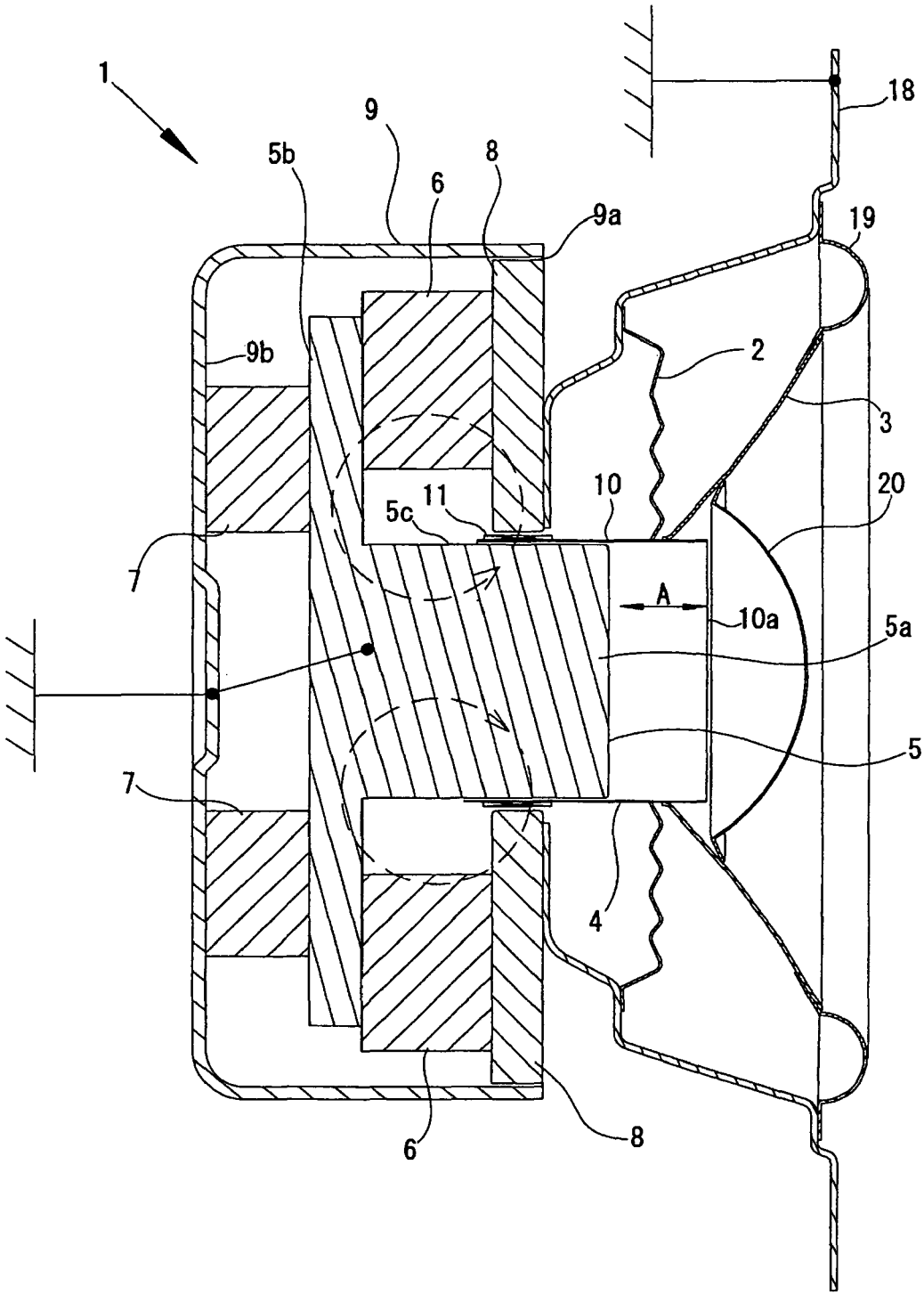

【Fig.2】
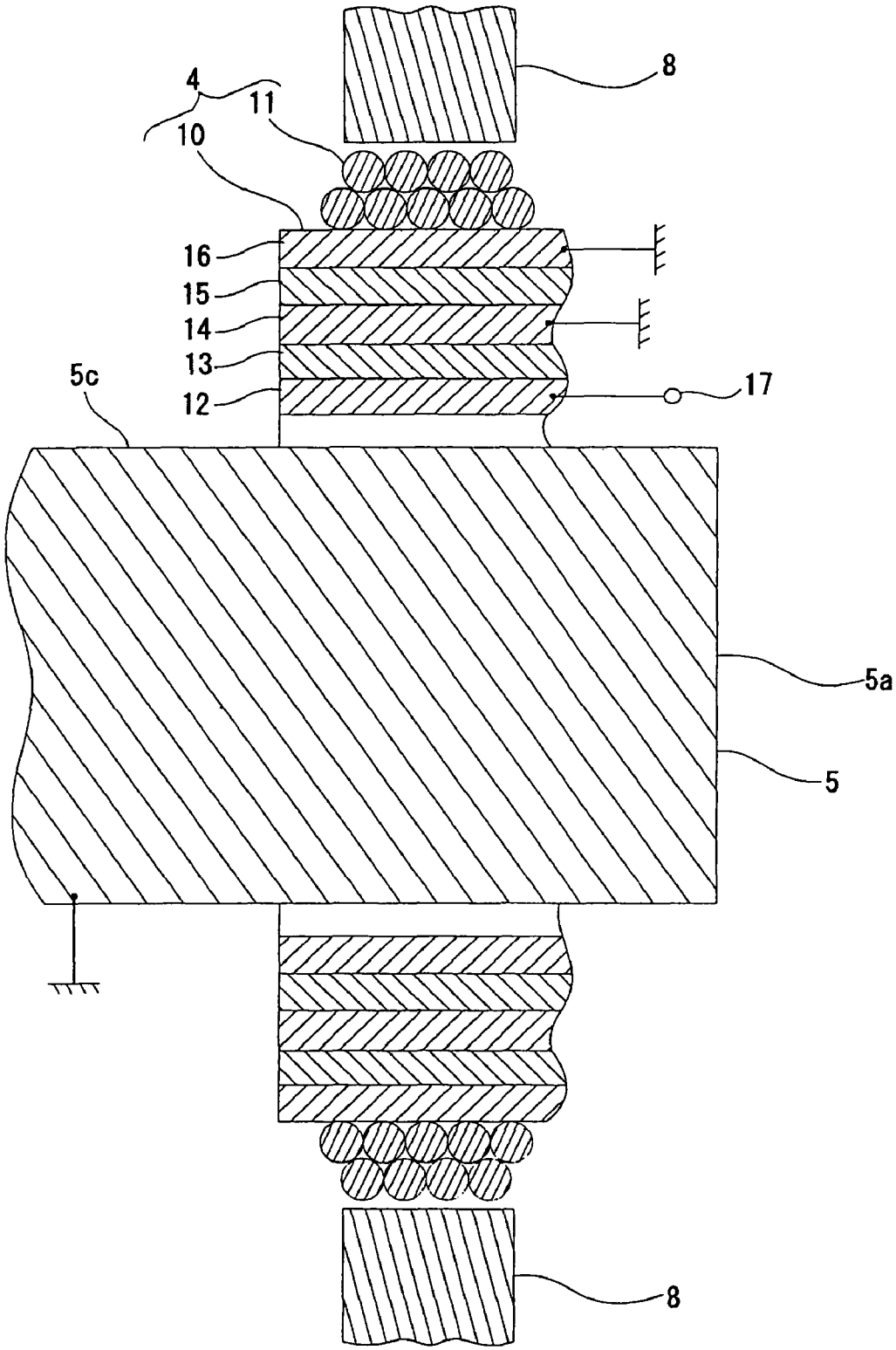

【Fig.3】
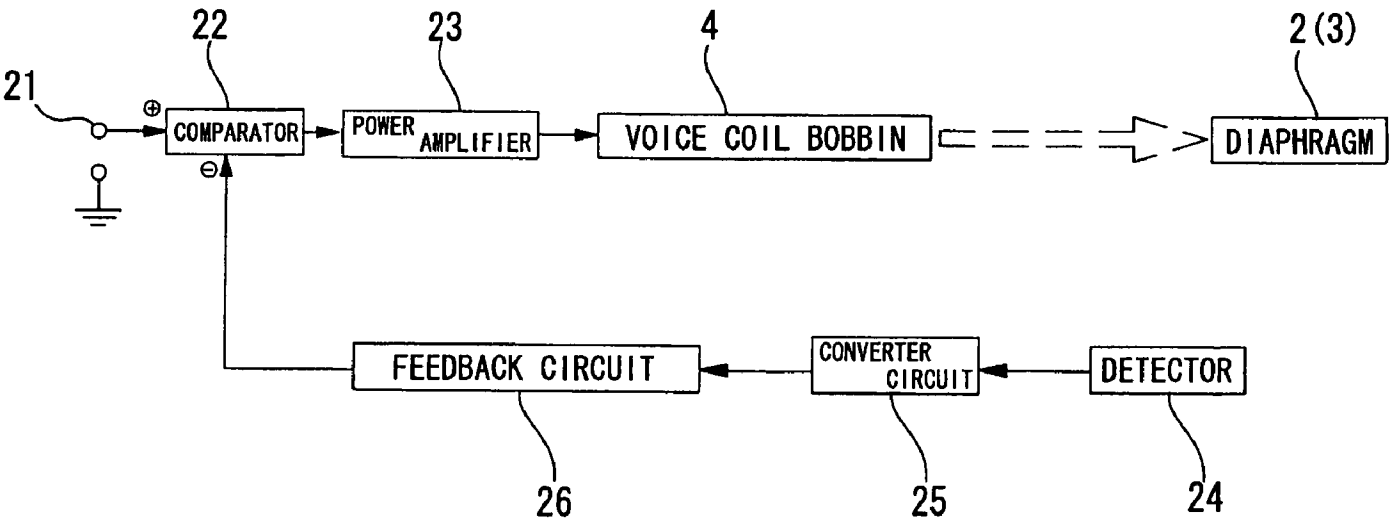

【Fig.4】
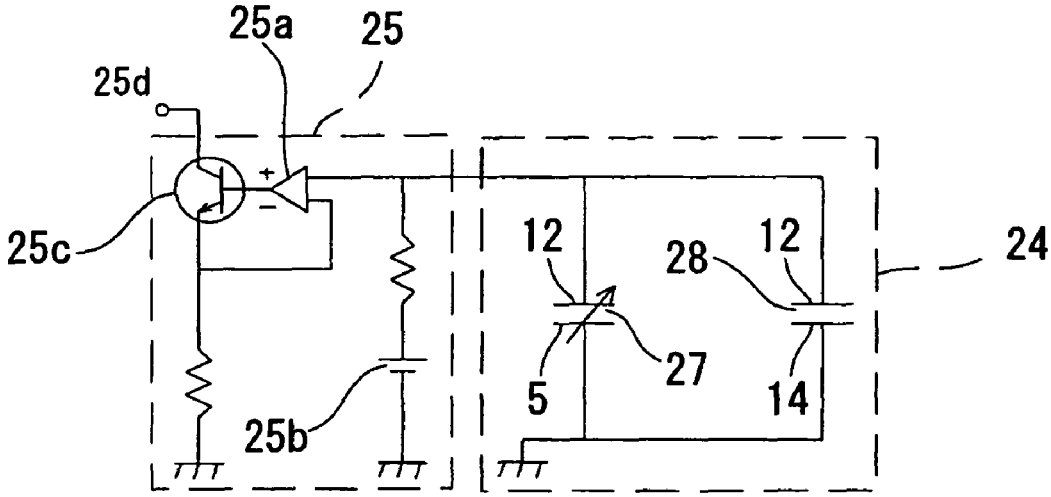

【Fig.5】
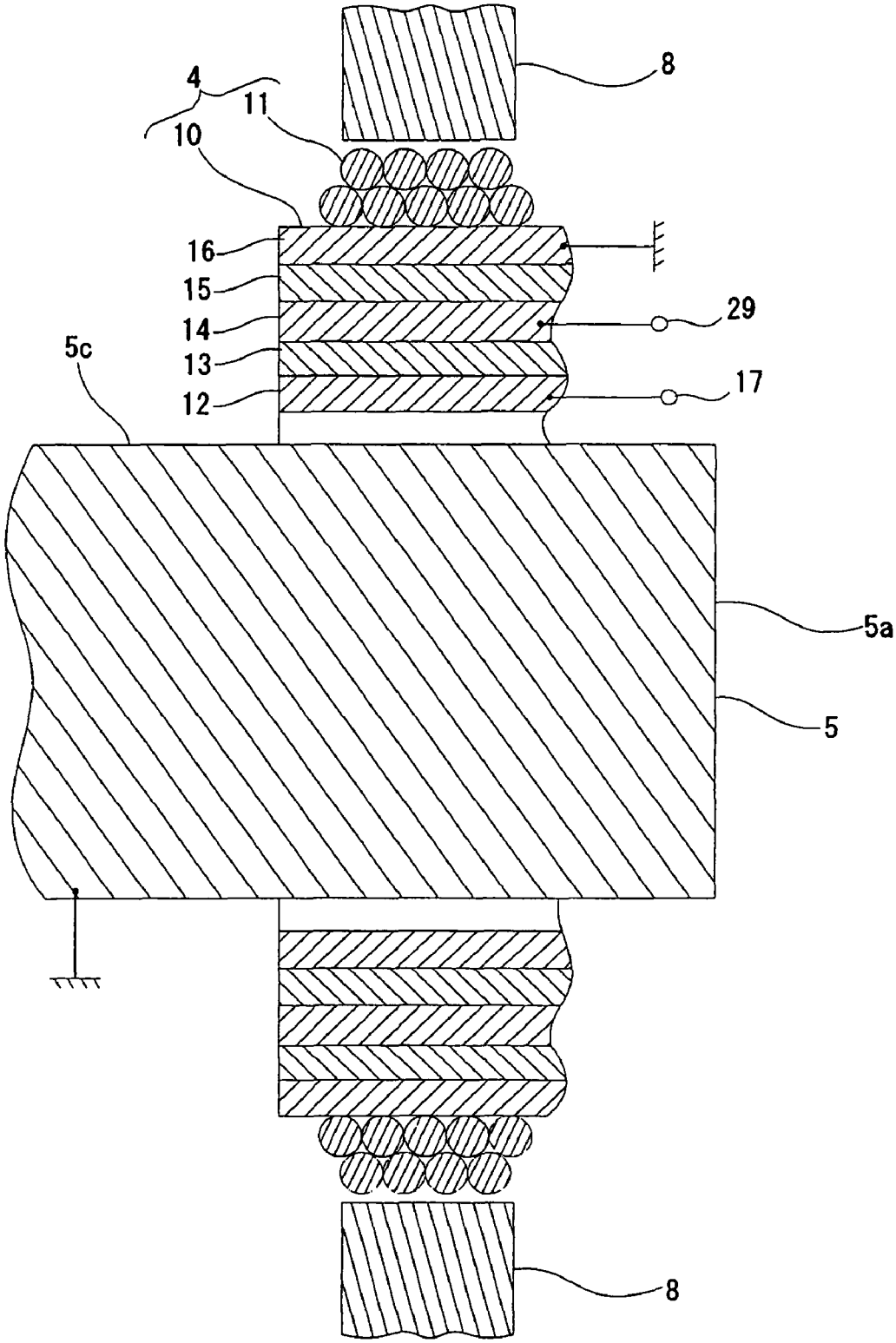

【Fig.6】
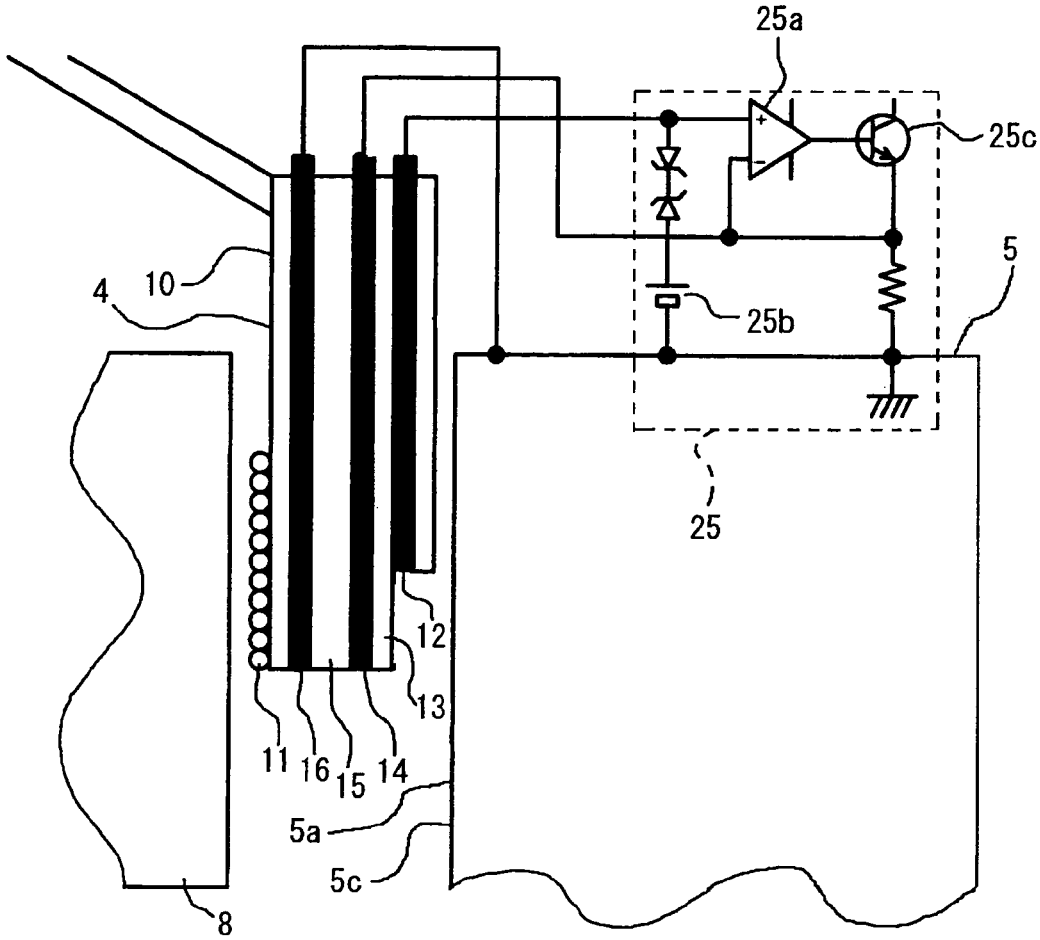

SPEAKER

CROSS REFERENCE TO RELATED APPLICATION

The present invention claims priority under 35 U.S.C. §119 to Japanese Application No. 2005-167529 filed Jun. 7, 2005, the contents of which are incorporated herein by reference.

FIELD OF THE INVENTION

An embodiment of the present invention may relate to a speaker. More specifically, an embodiment of the present invention may relate to a speaker that detects an operating state of the diaphragm of the speaker.

BACKGROUND OF THE INVENTION

In some audio speakers, a Motion Feed Back ("MFB") circuit is included to improve the sound quality of the speaker. The MFB circuit detects the operating state of a vibrating diaphragm through an electrical signal conveying audio information (hereinafter referred to as an "audio signal") that is inputted to a speaker. The MFB circuit controls the diaphragm based on the detection result. In this manner, the distortion of sound, which is likely to occur especially in a low tone region, can be canceled. Therefore, it is sometimes mistakenly assumed that the MFB circuit is effective to be utilized in a small-sized speaker in which reproduction in a low tone region is difficult.

For example, the following five references with regard to a MFB circuit are known: Japanese Patent Laid-Open No. Sho 52-79644, Japanese Patent Laid-Open No. Sho 53-12319, Japanese Patent Laid-Open No. Sho 53-12320, Japanese Patent Laid-Open No. Sho 53-12321, and Japanese Utility Model Laid-Open No. Sho 57-96589. In these references, the operating state of the diaphragm is detected by detecting the variation of an electrostatic capacity formed between electrodes. More specifically, an electrode (hereinafter referred to as "movable electrode") is fixed to a diaphragm, or to an electromagnetic coil which is referred to as a "voice coil bobbin" that causes the diaphragm to vibrate, and another electrode (hereinafter, referred to as "fixed electrode") is fixed so as to face the movable electrode. An electrostatic capacity, which varies by the movable electrode moving relative to the fixed electrode, is detected by a detector and is converted into an electrical signal (hereinafter, referred to as "detection signal") in a converter circuit to be outputted. Further, the detection signal and the audio signal are then compared with each other by a comparison device (a CPU, for example), and then the operation of the diaphragm is appropriately controlled on the basis of the compared result, i.e., the difference between the output level of the detection signal and the output level of the audio signal.

However, the electrostatic capacity that is formed between the electrodes is very small, for example, from several pF (picofarad) to several hundred pF. Therefore, the electrostatic capacity is affected and varied by noise such as a very small amount of an electromagnetic wave or static electricity. For example, a diaphragm is commonly structured to be vibrated by an excitation effect between a voice coil bobbin, an iron core which is inserted into the voice coil bobbin and referred to as a center pole, and a magnet which generates a magnetic flux passing through the voice coil bobbin and the center pole. However, the electrostatic capacity between the electrodes is affected and varied by an exciting current flowing through the voice coil bobbin. Further, some of electronic components which are incorporated into the speaker emit an electromagnetic wave although it may be weak, and the electrostatic capacity may be varied by the electromagnetic wave transmitting to the electrodes. Further, the electrostatic capacity between the electrodes may be affected by friction accompanied with mechanical phenomena such as the vibration of components which are incorporated in the speaker, static electricity caused by various electromagnetic phenomena in the inside and the outside of the speaker, electromagnetic waves which are outputted by electronic equipment installed around the speaker, or the like (hereinafter, referred to as "disturbance noise"). Thus, in the above-mentioned references, the electrostatic capacity varies and the electrostatic capacity formed between the electrodes is unable to be accurately detected.

BRIEF DESCRIPTION OF THE INVENTION

In view of the problems described above, an embodiment of the present invention may advantageously provide a speaker that is capable of accurately detecting an electrostatic capacity formed between electrodes without being affected by the disturbance noise.

Thus, according to an embodiment of the present invention, there may be provided a speaker including a center pole, and a voice coil bobbin having a bobbin comprising at least three nonmagnetic electric conductor layers and insulator layers disposed between the electric conductor layers. An electrostatic capacity which is formed between the center pole and the voice coil bobbin is detected and outputted as an electric signal.

In a speaker in accordance with an embodiment, a capacitor which is formed between the center pole and a first electric conductor layer facing the center pole (electric conductor layer whose distance from the center pole is shortest) and a capacitor that is formed between a second electric conductor layer (electric conductor layer adjacent to the first electric conductor layer) and the first electric conductor layer are connected to each other in parallel. In this case, the total amount of the electrostatic capacity which is formed between the center pole and the first electric conductor layer and the electrostatic capacity which is formed between the first electric conductor layer and the second electric conductor layer is detected. In other words, an electrostatic capacity larger than the electrostatic capacity that is formed only between the center pole and one electric conductor layer can be obtained and thus the effect of disturbance noise can be further prevented In addition, an additional electric conductor layer (except for or in addition to the first and the second electric conductor layers) may be included to function as a shield which blocks disturbance noise. Therefore, the true or real electrostatic capacity, i.e., not affected by disturbance noise, can be detected. In addition, the relative permittivity is increased by disposing an insulator layer between the electric conductor layers to cause the electrostatic capacity to be larger and thus effect of disturbance noise can be further prevented. In accordance with the embodiment described above, since the reliability of the detection result is enhanced, the MFB circuit is more effective, for example, the electric signal is effectively utilized in the MFB circuit and sound distortion from a speaker, especially a small speaker, which is a conventional problem can be reduced. Therefore, a low tone range similar to one in a large speaker can be realized even in a small speaker.

Specifically, in accordance with an embodiment, the electric conductor layers are comprised of a first electric conductor layer, a second electric conductor layer and a third electric conductor layer disposed around the center pole, and a first capacitor is formed by the center pole and the first electric conductor layer, and a second capacitor is formed by the first electric conductor layer and the second electric conductor layer. Further, the first capacitor and the second capacitor are connected in parallel to each other, and the total amount of the electrostatic capacity of the first capacitor and the electrostatic capacity of the second capacitor is outputted as the electric signal.

Further, in accordance with an embodiment, an electric conductor layer (except the nearest electric conductor layer with respect to the center pole) is grounded. In this case, the quantity of total amount of the electrostatic capacity which is formed between the center pole and the first electric conductor layer and the electrostatic capacity which is formed between the first electric conductor layer and the second electric conductor layer is increased. Further, the electrostatic capacity formed between the first electric conductor layer and the second electric conductor layer can be increased by grounding the second electric conductor layer. Therefore, the total electrostatic capacity is increased. Further, the shielding effect of the electric conductor layer can be enhanced and thus the true or real electrostatic capacity can be detected without being affected by disturbance noise.

Further, in accordance with an embodiment, a farthest electric conductor layer from the center pole is grounded and the electric signal is inputted into an intermediate electric conductor layer which is disposed between the nearest electric conductor layer and the farthest electric conductor layer. In this case, an intermediate electric conductor layer (electric conductor layer which is located between the first electric conductor layer and the farthest electric conductor layer from the center pole) functions as a so-called "bootstrap electrode" and thus a capacitor with a high degree of accuracy can be structured with the center pole and the voice coil bobbin. For example, impedance of the bobbin can be enhanced by converting the electrostatic capacity formed between the center pole and the first electric conductor layer into an electrical signal and feeding back the electrical signal to an intermediate electric conductor layer. Therefore, a capacitor which is difficult to affect by disturbance noise can be structured with the center pole and the voice coil bobbin. Accordingly, the reliability of the electrostatic capacity detected by the capacitor is further enhanced.

Other aspects, features, and advantages of the present invention will become more apparent from the following detailed description, taken in conjunction with the accompanying drawings that illustrate, by way of example, various aspects and features of exemplary embodiments of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 1 is a sectional view showing the structure of a speaker in accordance with a first embodiment of the present invention.

FIG. 2 is a cross-sectional view showing parts of a voice coil bobbin, a center pole and a yoke.

FIG. 3 is a functional block diagram showing an electrical structure of a speaker.

FIG. 4 is a circuit diagram showing a structure of a detector and a converter circuit.

FIG. 5 is a sectional view showing parts of a voice coil bobbin, a center pole and a yoke in accordance with a second embodiment of the present invention.

FIG. 6 is a circuit diagram showing a structure of a detector and a converter circuit in accordance with the second embodiment.

DETAILED DESCRIPTION OF THE PREFERRED EMBODIMENTS

An example of a speaker will be described in detail below with reference to the accompanying drawings.

A speaker in accordance with a first embodiment is shown in FIGS. 1 through 3. The speaker 1 in accordance with a first embodiment detects an electrostatic capacity that is formed between a center pole 5 and a voice coil bobbin 4 having a bobbin 10 comprising an insulating layer and a nonmagnetic and electric conductor layer to output the electrostatic capacity as an electric signal. In accordance with the first embodiment, the electric conductor layer of the bobbin 10 comprises a first electric conductor layer 12, a second electric conductor layer 14 and a third electric conductor layer 16. In other words, the electric conductor layer of the bobbin 10 may be structured of three or more electric conductor layers. In addition, a first insulating layer 13 is interposed between the first electric conductor layer 12 and the second electric conductor layer 14, and a second insulating layer 15 is interposed between the second electric conductor layer 14 and the third electric conductor layer 16, i.e., an insulating layer is interposed between the electric conductor layers.

As shown in FIG. 1, the speaker 1 includes diaphragms 2, 3, the voice coil bobbin 4, the center pole 5, magnets 6, 7, and a yoke 8. A case 9 is formed in a measured shape. The magnets 6 and 7 and the yoke 8 in addition to the center pole 5 are placed within the case 9 and these are fixed on the inner wall face of the case 9 with an adhesive or a screw. The center pole 5 is made of iron and includes a cylindrical main body 5*a* of the center pole 5 and a disk-shaped flange 5*b* that is formed at the base end of the main body 5*a* of the center pole 5. The center pole 5 is disposed such that the tip end portion of the main body 5*a* of the center pole 5 protrudes out of the case 9 from substantially the center of the opening 9*a* of the case 9.

The center pole 5 and the case 9 are connected to a housing (not shown), which is referred to as an enclosure and are grounded. The ring-shaped magnet 6 is magnetically attracted to a face of the flange 5*b* that faces the opening 9*a* so as to surround the main body 5*a* of the center pole 5 as its center. The substantially disk-shaped yoke 8 is magnetically attracted to the face of the magnet 6 that faces the opening 9*a* and thus the magnet 6 is disposed in a state that the magnet 6 is sandwiched by the yoke 8 and the flange 5*b* of the center pole 5. The ring-shaped magnet 7 whose shape is the same as the magnet 6 is disposed between the face of the flange 5*b* that faces the bottom part 9*b* of the case 9 and the bottom part 9*b* of the case 9. The magnet 7 is disposed on the bottom part 9*b* such that the pole of the magnet 7 on the side abutting with the flange 5*b* is the same pole of the magnet 6 on the side abutting with the flange 5*b*. According to the structure described above, a stable magnetic flux loop as described below is formed between the magnet 7, the yoke 8 and the center pole 5.

The substantially disk-shaped yoke 8 is disposed so as to be substantially perpendicular to the longitudinal axis in the longitudinal direction of the cylindrical main body 5*a* of the center pole 5. The yoke 8 is magnetically attracted to the magnet 6 such that the inner peripheral face of the yoke 8 faces the outer peripheral face 5*c* of the main body 5*a* of the center pole 5 and an air gap is formed between the inner peripheral face of the yoke 8 and the outer peripheral face 5*c*. Further, the inner peripheral face of the substantially disk-shaped yoke 8 faces the main body 5*a* of the center pole 5 within the case 9 and the outer peripheral face of the yoke 8 is disposed to be positioned close to the inner wall face of the case 9.

The voice coil bobbin 4 comprises a tubular shaped bobbin 10 whose front end and rear end are opened and a coil 11 which is wound around the outer periphery of the bobbin 10. A conductor such as an enameled wire or a copper wire is used as the coil 11, but another appropriate conductor may be used. As shown in FIG. 2, the bobbin 10 comprises a first electric conductor layer 12, a first insulating layer 13, a second electric conductor layer 14, a second insulating layer 15 and a third electric conductor layer 16. The first electric conductor layer 12, the second electric conductor layer 14 and the third electric conductor layer 16 are made of a copper foil, and the first insulating layer 13 and the second insulating layer 15 are made of a polyimide film. The bobbin 10 is structured by laminating the first electric conductor layer 12, the first insulating layer 13, the second electric conductor layer 14, the second insulating layer 15, and the third electric conductor layer 16 from the inner side to the outer side in this order. An insulating film (not shown) is formed between the coil 11 and the third electric conductor layer 16 by a coating process, and thus the coil 11 and the third electric conductor layer 16 are electrically insulated. A terminal 17, which is connected to the first electric conductor layer 12 through a lead wire, is connected to the non-inverting input terminal (see FIG. 4) of an operational amplifier 25*a* of a converter circuit 25 described below. The second and the third electric conductor layers 14, 16 are connected to a frame 18 (see FIG. 1) and are grounded.

As shown in FIG. 1, the bobbin 10 is installed in the case 9 so as to be capable of sliding or moving in forward and backward directions as shown by the arrow "A" in FIG. 1 and thus the bobbin 10 is capable of vibrating in the forward and backward directions by an exciting operation described below. The inside diameter of the bobbin 10 is set to be slightly larger than the outside diameter of the main body 5*a* of the center pole 5 and the bobbin 10 surrounds the main body 5*a* of the center pole 5. In other words, the coil 11 is arranged to face the inner peripheral face of the yoke 8 and the bobbin 10 surrounds around the main body 5*a* of the center pole 5 such that the inner peripheral face of the bobbin 10 is substantially parallel to the outer peripheral face 5*c* of the main body 5*a* of the center pole 5. Therefore, the inner peripheral face of the yoke 8 is located in proximity to the coil 11 and the inner peripheral face of the bobbin 10 is located in proximity to the outer peripheral face 5*c* of the main body 5*a* of the center pole 5. Therefore, a constant magnetic flux loop is always formed between the magnet 6, the yoke 8 and the center pole 5 in a circular arrow direction shown in FIG. 1. The magnet 6 and the yoke 8 may be appropriately disposed at positions where a constant magnetic flux can be formed between the center pole 5, the magnet 6 and the yoke 8.

The frame 18 is bonded with an adhesive on the face of the yoke 8 that is exposed on the outer side of the case 9. The frame 18 is bonded with a screw or an adhesive to the housing (not shown) and is grounded. The diaphragms 2, 3 are attached to the bobbin 10. The diaphragm 2 is a thin plate provided with a plurality of bent portions. One end of the diaphragm 2 is bonded to the outer peripheral face of the bobbin 10 and the other end of the diaphragm 2 is bonded to the frame 18 with an adhesive. The diaphragm 3 functions as a so-called cone paper. One end of the diaphragm 3 is bonded to the outer peripheral face of the bobbin 10 and the other end of the diaphragm 3 is connected with the frame 18 through a joint 19. A center cap 20 is made of aluminum or the like and comprises a main body part which is formed in a dome shape and a flange part which is formed along the outer circumferential edge of the main body part. The flange part of the center cap 20 is bonded to the diaphragm 3 with an adhesive. Therefore, the opening 10*a* of the bobbin 10 is covered by the center cap 20.

As shown in FIG. 3, an electric signal conveying or showing audio information (hereinafter, referred to as an "audio signal") that is inputted into an input terminal 21 is inputted to a power amplifier 23 through a comparator 22, which is comprised of a CPU (Central Processing Unit). The audio signal is amplified through the power amplifier 23 and then is inputted to the voice coil bobbin 4. In other words, an electric current showing an audio signal flows through the coil 11 of the voice coil bobbin 4 and the voice coil bobbin 4 is vibrated in a forward and backward direction (direction shown by the arrow "A" in FIG. 1) by interaction or an exciting operation between the electric current and the magnetic flux which is formed between the center pole 5, the magnet 6 and the yoke 8. As a result, the diaphragms 2 and 3 vibrate and a sound or the like is emitted from the speaker 1.

A detector 24, a converter circuit 25 and a feedback circuit 26 are provided in the speaker 1. The detector 24 comprises a first capacitor 27 and a second capacitor 28 (see FIG. 4) which will be described in detail below. As shown in FIG. 4, the converter circuit 25 comprises an operational amplifier 25*a*, a power source 25*b* and a transistor 25*c*. The non-inverting input terminal of the operational amplifier 25*a* and the first electric conductor layer 12 of the voice coil bobbin 4 are connected to each other through a lead wire attached at terminal 17 (see FIG. 2). A bias voltage is applied to the non-inverting input terminal of the operational amplifier 25*a* and the first electric conductor layer 12 by the power source 25*b*. The output terminal of the operational amplifier 25*a* is connected to the input terminal of the transistor 25*c* and thus the signal which is outputted from the output terminal of the operational amplifier 25*a* is inputted to the input terminal of the transistor 25*c*. The output terminal on the minus side, i.e., the emitter of the transistor 25*c* is connected to the inverting input terminal of the operational amplifier 25*a*. The output terminal on the minus side, i.e., the emitter of the transistor 25*c*, and the inverting input terminal of the operational amplifier 25*a* are connected to the center pole 5 and are grounded. The feedback circuit 26 is structured of an integration circuit (not shown), a buffer amplifier (not shown), an electronic volume (not shown), an adding circuit (not shown) and the like.

The first capacitor 27 comprises the center pole 5 and the first electric conductor layer 12. The second capacitor 28 comprises the first electric conductor layer 12 and the second electric conductor layer 14. Since the non-inverting input terminal of the operational amplifier 25*a* and the first electric conductor layer 12 of the voice coil bobbin 4 are connected to each other as described above, the first capacitor 27 and the second capacitor 28 are connected to each other in parallel. Therefore, the electrostatic capacity which is a total amount of an electrostatic capacity that is formed by the first capacitor 27 and the electrostatic capacity that is formed by the second capacitor 28 is the total electrostatic capacity and is inputted as an electric signal to the operational amplifier 25*a* of the converter circuit 25. As a result, an electric signal that is outputted from the detector 24 is C-V (electrostatic capacity-voltage) that is converted and amplified by the operational amplifier 25*a* and the transistor 25*c* to be outputted from the terminal 25*d* to the comparator 22 through the feedback circuit 26 as a detection signal. The comparator 22 compares the inputted detection signal with an audio signal inputted from the input terminal 21 and the result of the comparison is calculated. In other words, the difference between the output level of the audio signal and the output level of the detection signal is calculated. Next, the power amplifier 23 regulates the output level of the audio signal on the basis of the calculated result to input the audio signal to the voice coil bobbin 4. The voice coil bobbin 4 is vibrated on the basis of the audio signal inputted from the power amplifier 23.

As described above, according to the speaker 1 having a structure shown in FIGS. 1 through 4, when an audio signal is inputted into the input terminal 21, the voice coil bobbin 4 vibrates on the basis of the audio signal and the diaphragms 2 and 3 vibrate together with the vibration of the voice coil bobbin 4. The speaker 1 generates a sound or the like based on the vibration of the diaphragms 2 and 3. At this time, the operating state of the diaphragms 2 and 3 is recognized by detecting the electrostatic capacity with the detector 24. In other words, as the voice coil bobbin 4 vibrates forward and backward in direction A, the facing area of the first electric conductor layer 12 of the voice coil bobbin 4 to the outer peripheral face 5*c* of the main body 5*a* of the center pole 5 is varied, and thus the total amount of the electrostatic capacity formed by the first capacitor 27 and the electrostatic capacity formed by the second capacitor 28 varies too. The variation of the total amount corresponds to the magnitude of the displacement of the diaphragms 2 and 3. In this manner, an electric signal corresponding to the electrostatic capacity detected by the detector 24 is inputted into the converter circuit 25. The electric signal corresponding to the electrostatic capacity is converted into the detection signal in the converter circuit 25 and the detection signal is inputted to the comparator 22 via the feedback circuit 26. The comparator 22 compares the detection signal with the audio signal and the result of the comparison is inputted into the power amplifier 23 along with the audio signal. The power amplifier 23 regulates the audio signal to then be inputted to the voice coil bobbin 4 based on the result of the comparison.

According to an embodiment of the present invention, the bobbin 10 is comprised of the first electric conductor layer 12, the first insulating layer 13, the second electric conductor layer 14, the second insulating layer 15 and the third electric conductor layer 16. Further, the first capacitor 27 comprised of the center pole 5 and the first electric conductor layer 12 and the second capacitor 28 comprised of the first electric conductor layer 12 and the second electric conductor layer 14 are connected in a parallel manner. Therefore, in accordance with the embodiment described above, the total electrostatic capacity to be detected, which is an objective for detection, can be larger than that in a conventional case where only an electrostatic capacity which is formed between the center pole 5 and the first electric conductor layer 12 is detected. Accordingly, the electrostatic capacity can be detected without being substantially affected by a disturbance noise. Further, in accordance with an embodiment, the second electric conductor layer 14 and the third electric conductor layer 16 are electrically insulated from each other with the second insulating layer 15 and the third electric conductor layer 16 is grounded. Therefore, a disturbance noise can be intercepted. In addition, since the first insulating layer 13 is interposed between the first electric conductor layer 12 and the second electric conductor layer 14, the relative permittivity of the capacitor 27 and thus the electrostatic capacity can be increased.

Next, a second embodiment of the present invention will be described with reference to FIGS. 5 and 6. In FIGS. 5 and 6, the same notational symbols are used for the same structural members as those in the first embodiment and their detailed explanation is omitted.

A terminal 29 is connected to the second electric conductor layer 14 of the bobbin 10 through a lead wire. The terminal 29 is connected to the output terminal on the minus side, i.e., the emitter of a transistor 25*c* together with the inverting input terminal of an operational amplifier 25*a*. Therefore, a detection signal that is outputted from a converter circuit 25 is inputted to a feedback circuit 26 (see FIG. 3) and is inputted to the second electric conductor layer 14. In this manner, the impedance of the second electric conductor layer 14 is increased by the detection signal being inputted into the second electric conductor layer 14 and thus the second electric conductor layer 14 functions as a so-called bootstrap electrode. Therefore, a capacitor can be structured using center pole 5 and the first electric conductor layer 12, which is subject to minimal influence from a disturbance noise.

The present invention has been described in detail using the embodiments, but the present invention is not limited to the embodiments described above and many modifications can be made without departing from the present invention. In the embodiment described above, the bobbin 10 is structured including three electric conductor layers of the first conductor layer 12, the second conductor layer 14, and the third conductor layer 16. Insulating layer 13 is interposed between the first conductor layer 12 and the second conductor layer 14, and insulating layer 15 is interposed between conductor layer 14 and conductor layer 16. However, the present invention is not limited to the embodiment described above. For example, the bobbin 10 may be structured by using four or more electric conductor layers and insulating layers that are respectively interposed between the electric conductor layers. In this case, an electric conductor layer except the electric conductor layer whose distance from the center pole 5 is the shortest may be grounded. According to the structure described above, the electric conductor layer except the electric conductor layer whose distance from the center pole 5 is the shortest functions as a shield intercepting a disturbance noise. Further, electric conductor layers except the electric conductor layer whose distance from the center pole 5 is the shortest and the electric conductor layer next to this shortest conductor layer may be grounded, and a capacitor, which is formed by the center pole 5 and the electric conductor layer whose distance from the center pole 5 is the shortest, and a capacitor, which is formed by the electric conductor layer whose distance from the center pole 5 is the shortest and the electric conductor layer next to this shortest conductor layer, may be connected in parallel. According to the structure described above, a disturbance noise can be further surely intercepted and thus an electrostatic capacity can be formed which is hardly affected by a disturbance noise.

In the embodiment described above, the first electric conductor layer 12, the second electric conductor layer 14 and the third electric conductor layer 16 are formed of a copper foil. However, they may be formed of aluminum or electro-conductive plastic and another nonmagnetic and electric conductor may be appropriately utilized. Further, in the embodiments described above, the first and the second insulating layers 13, 15 are formed of polyimide. However, they may be formed of, for example, a paper, and another insulator may be appropriately utilized.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A speaker comprising:

a center pole; and a voice coil bobbin including a bobbin comprising at least three or more nonmagnetic electric conductor layers, which are respectively arranged from closest to the center pole to farthest from the center pole, and also including insulator layers disposed between the electric conductor layers;

wherein an electrostatic capacity, which is formed between the center pole and the voice coil bobbin, is detected and outputted as an electrical signal, and the electric conductor layers except the nearest electric conductor layer to the center pole are grounded.

2. A speaker comprising:

a center pole; and a voice coil bobbin including a bobbin comprising at least three or more nonmagnetic electric conductor layers, which are respectively arranged from closest to the center pole to farthest from the center pole, and also including insulator layers disposed between the electric conductor layers;

wherein an electrostatic capacity, which is formed between the center pole and the voice coil bobbin, is detected and outputted as an electrical signal, and a farthest electric conductor layer from the center pole is grounded, and the electric signal is inputted into an intermediate electric conductor layer which is disposed between the nearest electric conductor layer and the farthest electric conductor layer.

3. A speaker comprising:

a center pole; and a voice coil bobbin including a bobbin comprising at least three or more nonmagnetic electric conductor layers, which are respectively arranged from closest to the center pole to farthest from the center pole, and also including insulator layers disposed between the electric conductor layers;

wherein an electrostatic capacity, which is formed between the center pole and the voice coil bobbin, is detected and outputted as an electrical signal, the electric conductor layers are comprised of a first electric conductor layer, a second electric conductor layer and a third electric conductor layer, a first capacitor is formed by the center pole and the first electric conductor layer, and a second capacitor is formed by the first electric conductor layer and the second electric conductor layer, and the first capacitor and the second capacitor are connected in parallel to each other, and a total amount of an electrostatic capacity of the first capacitor and an electrostatic capacity of the second capacitor is outputted as the electrical signal.

4. The speaker according to claim 3, wherein the third electric conductor layer is grounded.

* * * * *